US010449425B2

(12) United States Patent
Mizutani

(10) Patent No.: US 10,449,425 B2
(45) Date of Patent: Oct. 22, 2019

(54) GOLF CLUB HEAD

(71) Applicant: SUMITOMO RUBBER INDUSTRIES, LTD., Hyogo (JP)

(72) Inventor: Naruhiro Mizutani, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/028,201

(22) Filed: Jul. 5, 2018

(65) Prior Publication Data

US 2019/0009141 A1 Jan. 10, 2019

(30) Foreign Application Priority Data

Jul. 6, 2017 (JP) ..... 2017-133174

(51) Int. Cl.
*A63B 53/04* (2015.01)

(52) U.S. Cl.
CPC .... *A63B 53/0466* (2013.01); *A63B 2053/045* (2013.01); *A63B 2053/0416* (2013.01); *A63B 2053/0425* (2013.01); *A63B 2053/0458* (2013.01); *A63B 2053/0462* (2013.01)

(58) Field of Classification Search
CPC ..... A63B 53/0466; A63B 2053/0416; A63B 2053/0425; A63B 2053/045; A63B 2053/0458; A63B 2053/0462
USPC ..... 473/342, 345
See application file for complete search history.

(56) References Cited

U.S. PATENT DOCUMENTS

2005/0124436 A1* 6/2005 Kakiuchi ..... A63B 53/0466 473/345
2015/0238827 A1* 8/2015 Nakamura ..... A63B 53/0466 473/345
2016/0184666 A1* 6/2016 Mizutani ..... A63B 53/0466 473/342

FOREIGN PATENT DOCUMENTS

JP 2005-006698 A 1/2005

* cited by examiner

*Primary Examiner* — Michael D Dennis
(74) *Attorney, Agent, or Firm* — Studebaker & Brackett PC

(57) ABSTRACT

A golf club head according to the present invention includes: a head main body including a crown part and a sole part, and having an opening surrounded by the crown part and the sole part; and a face member covering the opening in the head main body. The face member is formed in a cup-like shape, including a face part formed in a planar shape and a peripheral edge part extending from a peripheral edge of the face part. An end surface forming the opening in the head main body is formed extending parallel to the face part. The crown part of the head main body includes: a front-side region extending in a toe-heel direction along an edge part on the side where the opening is located; and a rear-side region located further on a back side than the front-side region and being thinner than the front-side region.

10 Claims, 5 Drawing Sheets

Cross Section E1

GOLF CLUB HEAD

TECHNICAL FIELD

The present invention relates to a golf club head.

BACKGROUND ART

Wood-type golf club heads have been undergoing many improvements for some time. Drivers in particular have seen various proposals for extending driving distances. For example, some clubs employ a face part having what is known as a "cup face construction", such as that described in JP 2005-6698A. Specifically, the head is constituted by a head main body in which an opening is formed and a face member that covers the opening in the head main body. The face member includes a plate-shaped face part and a peripheral edge part extending from the peripheral edges of the face part, which forms a cup-like shape. Providing the face member with such a peripheral edge part increases the amount by which the face member flexes when striking a ball. This has the effect of improving the rebound performance and extending the driving distance.

The golf club head described in JP 2005-6698A improves the rebound performance particularly by adjusting the thickness of a crown part. In other words, the crown part of the head main body is made thinner than the peripheral edge part of the face member facing the crown part. Furthermore, the parts of the peripheral edge part of the face member that face the crown part of the head main body are adjusted. Namely, the length of projection from a base part of the peripheral edge part is made shorter in a central part with respect to the toe-heel direction, and the length of projection of the peripheral edge part on either side thereof, that is, the toe side and the heel side, is made longer. In other words, a recessed part is formed near the center of the peripheral edge part. A protruding part corresponding to the recessed part is formed near the center of the crown part in the opening in the head main body, and the protruding part fits into the recessed part of the peripheral edge part. This results in a greater number of thin parts near the center of the crown part, which improves the rebound performance. On the other hand, a greater number of thick parts, matching the thickness of the peripheral edge part, are present on the toe side and heel side of the crown part, which improves the durability.

JP 2005-6698A is an example of related art.

SUMMARY OF THE INVENTION

However, although this type of structure does improve the rebound performance near the center in the toe-heel direction, there is still room for improvement of the rebound performance on the toe side and the heel side. Having been achieved in order to solve this problem, an object of the present invention is to provide a golf club head that improves rebound performance on a toe side and a heel side while employing a cup face construction.

A golf club head according to the present invention includes: a head main body including a crown part and a sole part, and having an opening surrounded by the crown part and the sole part; and a face member covering the opening in the head main body. The face member is formed in a cup-like shape, including a face part formed in a planar shape and a peripheral edge part extending from a peripheral edge of the face part. An end surface forming the opening in the head main body is formed extending parallel to the face part. The crown part of the head main body includes: a front-side region extending in a toe-heel direction along an edge part on the side where the opening is located; and a rear-side region located further on a back side than the front-side region and being thinner than the front-side region. The front-side region includes: a first toe-side edge part located on a toe side; a first heel-side edge part located on a heel side; and a first central edge part located between the first toe-side edge part and the first heel-side edge part and being thicker than the first toe-side edge part and the first heel-side edge part. The first toe-side edge part and the first heel-side edge part are longer than the first central edge part in the face-back direction.

In the above-described golf club head, a part of the peripheral edge part of the face member, extending along the crown part, can include a second toe-side edge part, a second heel-side edge part, and a second central edge part joined to the first toe-side edge part, the first heel-side edge part, and the first central edge part, respectively; and the second central edge part can be made thicker than the second toe-side edge part and the second heel-side edge part.

In the above-described golf club head, the second toe-side edge part can include a front-side second toe-side edge part located on a face side and a rear-side second toe-side edge part located on a back side; the second heel-side edge part can include a front-side second heel-side edge part located on the face side and a rear-side second heel-side edge part located on the back side; the front-side second toe-side edge part can be made thicker than the rear-side second toe-side edge part; and the front-side second heel-side edge part can be made thicker than the rear-side second heel-side edge part.

In the above-described golf club head, the rear-side second toe-side edge part and the first toe-side edge part can be joined, and can have the same thickness; and the rear-side second heel-side edge part and the first heel-side edge part can be joined, and can have the same thickness.

In the above-described golf club head, the head can be formed so that a thickness progressively decreases from a face-side end edge of the rear-side second toe-side edge part toward a back-side end edge of the first toe-side edge part; and a thickness progressively decreases from a face part-side end edge of the rear-side second heel-side edge part toward a back-side end edge of the first heel-side edge part.

In each of the above-described golf club heads, a movement region extending in the toe-heel direction and having a thickness that changes progressively can be provided between the front-side region and the rear-side region.

In each of the above-described golf club heads, at least one thin part can be formed in the rear-side region.

According to the present invention, rebound performance can be improved on a toe side and a heel side while employing a cup face construction.

EMBODIMENTS OF THE INVENTION

Figure 1:
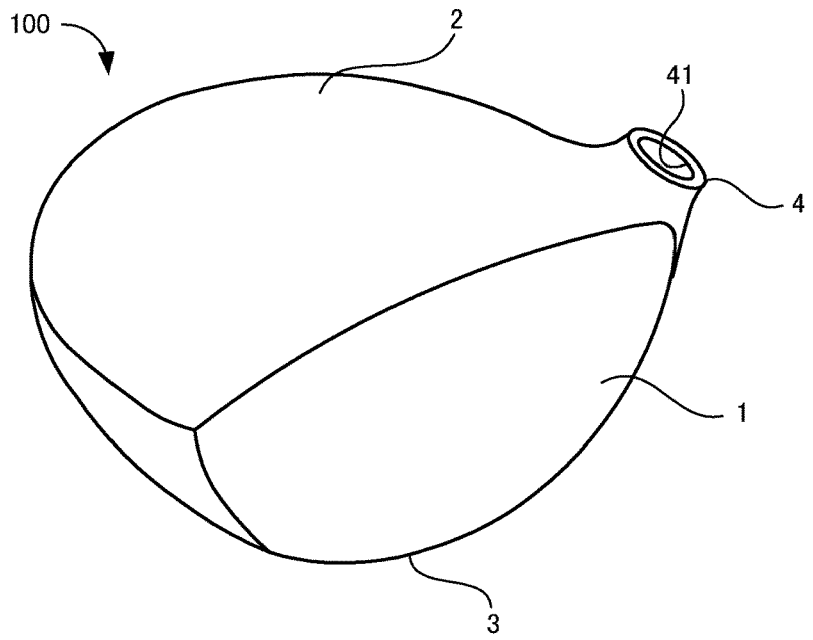
FIG. 1 is a perspective view of a golf club head according to an embodiment in a reference state.
Figure 2:
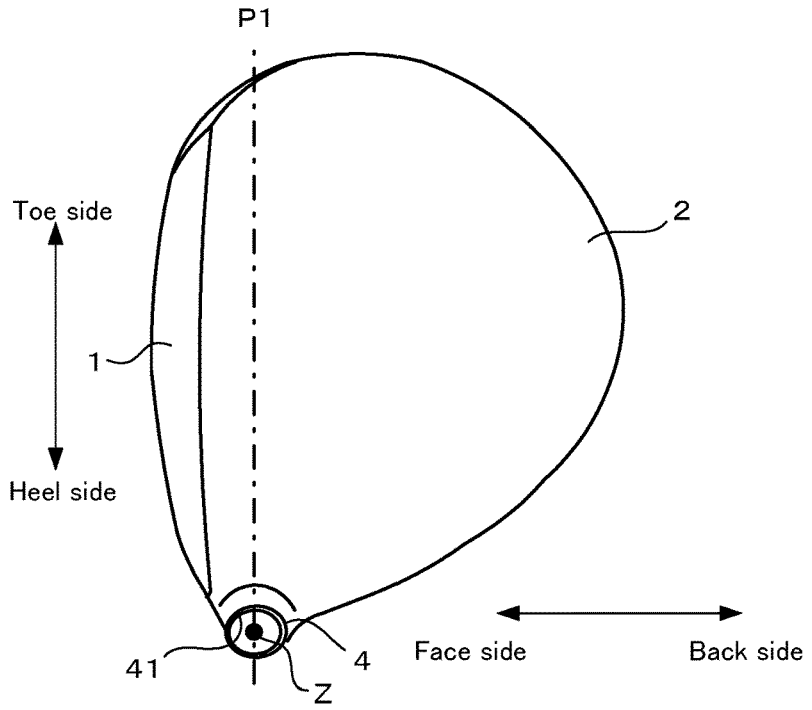
FIG. 2 is a plan view corresponding to FIG. 1.

An embodiment of a golf club head according to the present invention will be described hereinafter with reference to the drawings. FIG. 1 is a perspective view of the golf club head according to the present embodiment in a reference state, and FIG. 2 is a plan view corresponding to FIG. 1. The reference state of the golf club head will be described later.

1. Overview of Golf Club Head

As illustrated in FIG. 1, a golf club head (also sometimes called simply a "head" hereinafter) 100 according to the present embodiment has a hollow construction, with wall surfaces formed by a face part 1, a crown part 2, a sole part 3, and a hosel part 4.

The face part 1 has a face surface, which is a surface that strikes a ball. The crown part 2 is adjacent to the face part 1 and forms an upper surface of the head 100. The sole part 3 mainly forms a bottom surface of the head 100, and constitutes the outer peripheral surface of the head 100 excluding the face part 1 and the crown part 2. In other words, in addition to the bottom surface of the head 100, a part extending from a toe side of the face part 1, across a backside of the head, and to a heel side of the face part 1 is part of the sole part 3. Furthermore, the hosel part 4 is a part provided adjacent to a heel side of the crown part 2, and has an insertion hole 41 into which a shaft (not shown) of a golf club is inserted. A center axis line Z of the insertion hole 41 coincides with an axis line of the shaft. Although the head described here is a wood type, such as a driver (#1 ) or a fairway wood, the head is not limited to this type, and may instead be what is known as a utility type, a hybrid type, or the like.

A reference state when the golf club head 100 is placed on a ground surface will be described next. First, as illustrated in FIG. 2, a state in which the center axis line Z is present in a plane P1 perpendicular to the ground surface and the head is placed on the ground surface at a prescribed lie angle and real loft angle, is defined as the "reference state". The plane P1 is called a "reference vertical plane". Also, as illustrated in FIG. 2, the direction of an intersecting line between the reference vertical plane P1 and the ground surface is called a "toe-heel direction", and a direction perpendicular to the toe-heel direction and parallel to the ground surface is called a "face-back direction". In the face-back direction, the face side may be referred to as a "front side" and the back side as a "rear side".

Figure 3A:
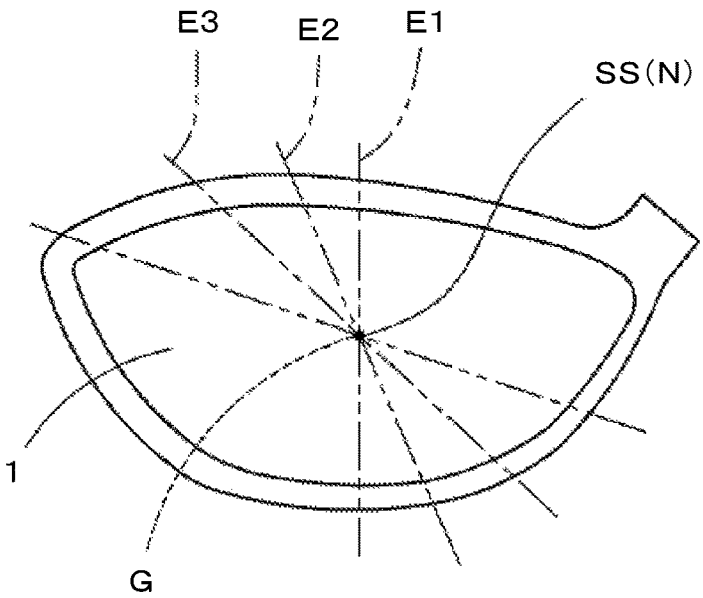
FIG. 3A is a diagram illustrating the boundaries of a face part.
Figure 3B:
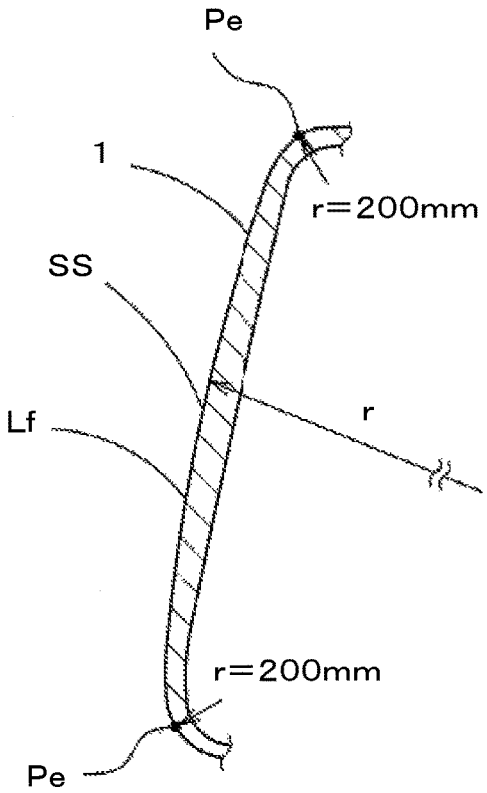
FIG. 3B is a diagram illustrating the boundaries of the face part.

In the present embodiment, a boundary between the face part 1 and the crown part 2, and a boundary between the face part 1 and the sole part 3, can be defined as follows. If a ridge line is formed between these elements, that ridge line serves as the boundary. However, if a clear ridge line is not formed, the boundaries are defined as follows. In each of cross-sections E1, E2, E3, and so on illustrated in FIG. 3A, each of which contains a straight line N connecting ahead center of gravity G with a sweet spot SS, a position Pe where a curvature radius r of a face outer surface contour line Lf first reaches 200 mm while moving from the sweet spot side toward the face outer side, as illustrated in FIG. 3B, serves as a peripheral edge of the face part 1. This is defined as the boundary with the crown part 2 or the sole part 3. The "sweet spot SS" is a point of intersection between a normal line of the face surface passing through the head center of gravity G (the straight line N) and that face surface.

Additionally, in the present embodiment, a boundary between the crown part 2 and the sole part 3 can be defined as follows. If a ridge line is formed between the crown part 2 and the sole part 3, that ridge line serves as the boundary. However, if a clear ridge line is not formed between these elements, the head is placed in the reference state and a contour seen from directly above the center of gravity of the head 100 serves as the boundary.

The head 100 can be formed of, for example, a titanium alloy (Ti-6Al-4V, Ti-8Al-1Mo-1V, or the like) having a relative density of approximately 4.3 to 4.5. Aside from titanium alloys, the head can be formed using one or more of stainless steel, mariaging steel, an aluminum alloy, a magnesium alloy, an amorphous alloy, and so on, for example.

The volume of the golf club head 100 is preferably greater than or equal to 90 $cm^3$ and less than or equal to 470 $cm^3$, for example.

2. Assembly Structure of Golf Club Head

Figure 4:
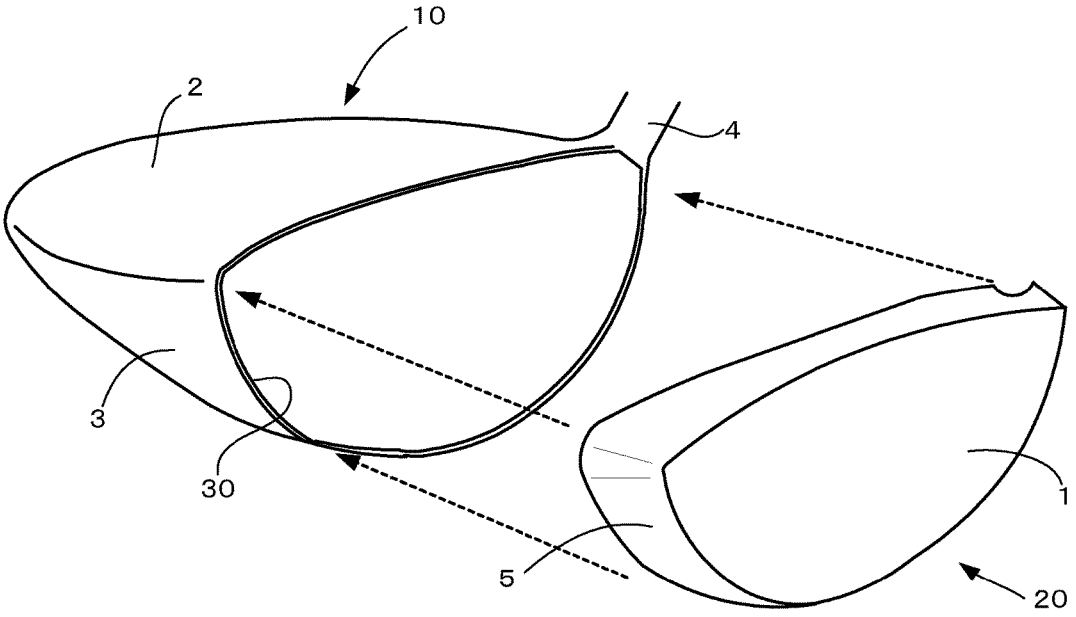
FIG. 4 is a perspective view illustrating the assembly of a head.

As illustrated in FIG. 4, the golf club head according to the present embodiment is formed by assembling a head main body 10, which includes the crown part 2 and the sole part 3, with a face member 20, which includes the face part 1 and a peripheral edge part 5 extending from the peripheral edges of the face part 1 to form a cup-like shape. The head main body 10 has an opening 30 surrounded by the crown part 2 and the sole part 3, and the face member 20 is attached so as to cover the opening 30. In other words, an end surface of the peripheral edge part 5 of the face member 20 butts against an end surface of the opening 30, and these are joined together by welding. The face member 20 is integrated with the head main body 10 by being attached to the opening in the head main body 10. As a result, the peripheral edge part 5 of the face member 20 functions as a part of the crown part 2 and the sole part 3. Accordingly, an integral surface formed by attaching the peripheral edge part 5 of the face member 20 to the head main body 10 forms the crown part 2 and the sole part 3. As such, the parts of the head main body 10 are, strictly speaking, parts of the crown part 2 and the sole part 3. However, the following may not make this distinction, with the parts of the head main body 10 also being referred to as the crown part 2 and the sole part 3.

3. Structure of Crown Part

Figure 5:
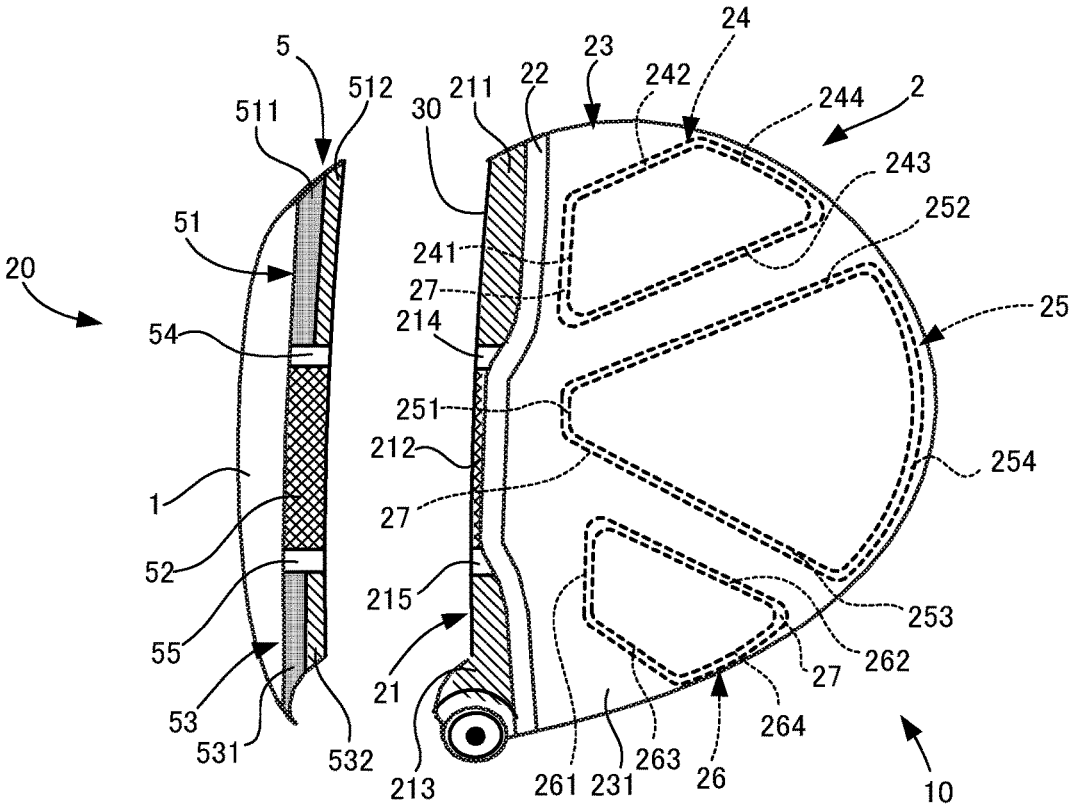
FIG. 5 is a plan view in which the head, in a reference state, has been divided into a head main body and a face member.

The crown part 2 of the head main body 10 will be described next with reference to FIG. 5. FIG. 5 is a plan view in which the head 100, in the reference state, has been divided into the head main body 10 and the face member 20. Note that the various parts in FIG. 5 have been shaded by hatching for the sake of visibility.

First, the shape of an opening edge part of the crown part 2 as illustrated in FIG. 5 will be described. As described above, the end surface of the opening 30 in the crown part 2 extends in the toe-heel direction so as to be substantially parallel to the face part 1. A band-shaped front side region 21, which extends in the toe-heel direction, is provided in an edge part of the crown part 2 on the opening side. A band-shaped movement region 22, which extends in the toe-heel direction, is provided on the back side of the front side region 21, and a rear side region 23 is furthermore provided on the back side of the movement region 22. The front side region 21 is formed thicker than the rear side region 23. The movement region 22 is formed so as to become progressively thinner between a rear-end edge of the front side region 21 and a front-end edge of the rear side region 23.

The front side region 21 will be described next. The front side region 21 is provided with a first toe-side edge part 211, a first central edge part 212, and a first heel-side edge part 213, in that order from the toe side to the heel side. These parts are formed as bands extending in the toe-heel direction. The first central edge part 212 is formed thicker than the first toe-side edge part 211 and the first heel-side edge part 213. Movement parts 214 and 215, which have thicknesses that change progressively, are formed between the first toe-side edge part 211 and the first central edge part 212, and between the first heel-side edge part 213 and the first central edge part 212, respectively. The first central edge part 212 can be 0.5 to 1.1 mm thick, for example, and the first toe-side edge part 211 and the first heel-side edge part 213 can be 1.0 to 1.5 mm thick, for example.

The first toe-side edge part 211 and the first heel-side edge part 213 are longer in the face-back direction than the first central edge part 212. In other words, the rear-end edges of the first toe-side edge part 211 and the first heel-side edge part 213 are located further to the back side than the rear-end edge of the first central edge part 212. The rear-end edge of the front side region 21 is therefore formed slanting from the first toe-side edge part 211 toward the first central edge part 212. Likewise, the rear-end edge of the front side region 21 is formed slanting from the first heel-side edge part 213 toward the first central edge part 212. A length from the joint face between the first toe-side edge part 211 and the first heel-side edge part 213 in the face-back direction can be set to 5.0 to 10.0 mm, and a length of the first central edge part 212 in the face-back direction can be set to 1.0 to 5.0 mm. The movement region 22 is formed along the rear-end edge of the front side region 21, and is thus recessed toward the face side at positions corresponding to the first central edge part 212. The length of the movement region 22 in the face-back direction is substantially constant.

The rear side region 23 will be described next. In the present embodiment, the rear side region 23 includes a main body part 231 and three thin parts 24, 25, and 26 formed in the main body part 231. The thin parts 24, 25, and 26 are formed thinner than the main body part 231. For example, the main body part 231 can be set to 0.5 to 0.8 mm thick, and the thin parts 24, 25, and 26 can be set to 0.3 to 0.6 mm thick.

The three thin parts will be referred to as a first thin part 24, a second thin part 25, and a third thin part 26, in that order from the toe side to the heel side. The first thin part 24 is located on the toe side, and is formed having a trapezoidal shape. To describe in more detail, the first thin part 24 is a region surrounded by four sides. In other words, the first thin part 24 is surrounded by: a first side 241, which is separated from the movement region 22 by a gap and extends in the toe-heel direction while facing the first toe-side edge part 211; a second side 242, which extends, from a toe-side end part of the first side 241, at an angle toward the toe side as the second side 242 progresses toward the back side; a third side 243, which extends, from a heel-side end part of the first side 241, at an angle toward the toe side as the third side 243 progresses toward the back side; and a fourth side 244, which connects the back-side end parts of the second side 242 and the third side 243, and extends along the peripheral edge of the crown part 2.

The second thin part 25 is a region surrounded by four sides, and is substantially fan-shaped. In other words, the second thin part 25 is surrounded by: a first side 251, which is separated from the movement region 22 by a gap and extends in the toe-heel direction while facing the first central edge part 212; a second side 252, which extends, from a toe-side end part of the first side 251, at an angle toward the toe side as the second side 252 progresses toward the back side; a third side 253, which extends, from a heel-side end part of the first side 251, at an angle toward the heel side as the third side 253 progresses toward the back side; and a fourth side 254, which connects the back-side end parts of the second side 252 and the third side 253, and extends along the peripheral edge of the crown part 2.

The third thin part 26 is a region surrounded by four sides, and has a substantially trapezoidal shape. In other words, the third thin part 22 is surrounded by: a first side 261, which is separated from the movement region 22 by a gap and extends in the toe-heel direction while facing the first heel-side edge part 213; a second side 262, which extends, from a toe-side end part of the first side 261, at an angle toward the heel side as the second side 262 progresses toward the back side; a third side 263, which extends, from a heel-side end part of the first side 261, at an angle toward the heel side as the third side 263 progresses toward the back side; and a fourth side 264, which connects the back-side end parts of the second side 262 and the third side 263, and extends along the peripheral edge of the crown part 2.

Gaps are formed between the three thin parts 24, 25, and 26. In other words, the third side 243 of the first thin part 24 and the second side 252 of the second thin part 25 extend substantially parallel to each other, and a gap having a constant width is formed between those sides. Likewise, the third side 253 of the second thin part 25 and the second side 262 of the third thin part 26 extend substantially parallel to each other, and a gap having a constant width is formed between those sides. Note that these gaps are part of the main body part 231, and are thicker than the thin parts 24, 25, and 26.

Movement parts 27 are provided at the boundaries between the thin parts 24, 25, and 26 and the main body part 231, and the movement parts 27 have thicknesses that change progressively.

4. Structure of Face Member

The face member 20 will be described next. As described above, the face member 20 includes the plate-shaped face part 1 and the peripheral edge part 5. The peripheral edge part 5 is formed having a substantially constant width (length of projection from the face part 1). As illustrated in FIG. 5, a region, of the peripheral edge part 5, located on the crown part side, has three band-shaped regions arranged in the toe-heel direction. In other words, there are a second toe-side edge part 51, a second central edge part 52, and a second heel-side edge part 53 arranged in that order from the toe side to the heel side, and these parts are joined to the first toe-side edge part 211, the first central edge part 212, and the first heel-side edge part 213, respectively, of the head main body 10. Accordingly, the lengths of the second toe-side edge part 51, the second central edge part 52, and the second heel-side edge part 53 in the toe-heel direction are substantially the same as the lengths of the first toe-side edge part 211, the first central edge part 212, and the first heel-side edge part 213 of the head main body 10, respectively.

The second central edge part 52 is formed thicker than the second toe-side edge part 51 and the second heel-side edge part 53. A second central edge part 52 has the same thickness as the first central edge part 212 to which the second central edge part 52 is joined. Furthermore, movement parts 54 and 55, which have thicknesses that change progressively, are formed between the second toe-side edge part 51 and the second central edge part 52, and between the second heel-side edge part 53 and the second central edge part 52, respectively.

The second toe-side edge part 51 and the second heel-side edge part 53 are each formed by two regions arranged in the face-back direction. In other words, the second toe-side edge part 51 includes a front-side second toe-side edge part 511 on the face side and a rear-side second toe-side edge part 512 on the back side. These parts are both formed as bands extending in the toe-heel direction. Likewise, the second heel-side edge part 53 includes a front-side second heel-side edge part 531 on the face side and a rear-side second heel-side edge part 532 on the back side. These parts are both formed as bands extending in the toe-heel direction, and the lengths thereof in the face-back direction are the same as the front-side second toe-side edge part 511 and the rear-side second toe-side edge part 512, respectively.

The front-side second toe-side edge part 511 and the front-side second heel-side edge part 531 have substantially the same thickness. Likewise, the rear-side second toe-side edge part 512 and the rear-side second heel-side edge part 532 have substantially the same thickness. The front-side second toe-side edge part 511 and the front-side second heel-side edge part 531 are thicker than the rear-side second toe-side edge part 512 and the rear-side second heel-side edge part 532, and can be set to a thickness of 0.6 to 1.2 mm. The rear-side second toe-side edge part 512 has the same thickness as the first toe-side edge part 211 to which the rear-side second toe-side edge part 512 is joined. Likewise, the rear-side second heel-side edge part 532 has the same thickness as the first heel-side edge part 213 to which the rear-side second heel-side edge part 532 is joined. Making these thicknesses the same makes it possible to suppress situations where stress concentrates at the joint parts.

5. Method of Manufacturing Golf Head

An example of a method of manufacturing the golf club head having such a configuration will be described next. The head main body of the golf club head according to the present embodiment is manufactured through, for example, a known casting method such as lost-wax precision casting. On the other hand, the face member 20 can be manufactured through a forging method, a process of pressing a flat plate, casting, or the like, for example. The opening in the completed head main body 10 is butted against the peripheral edge part 5 of the face member 20, and the parts butted together are then joined through welding. A method such as tungsten-inert gas (TIG) welding, plasma welding, laser welding, brazing, or the like can be used as the welding method. Then, once painting or the like has been carried out, the golf club head is complete.

Figure 6:
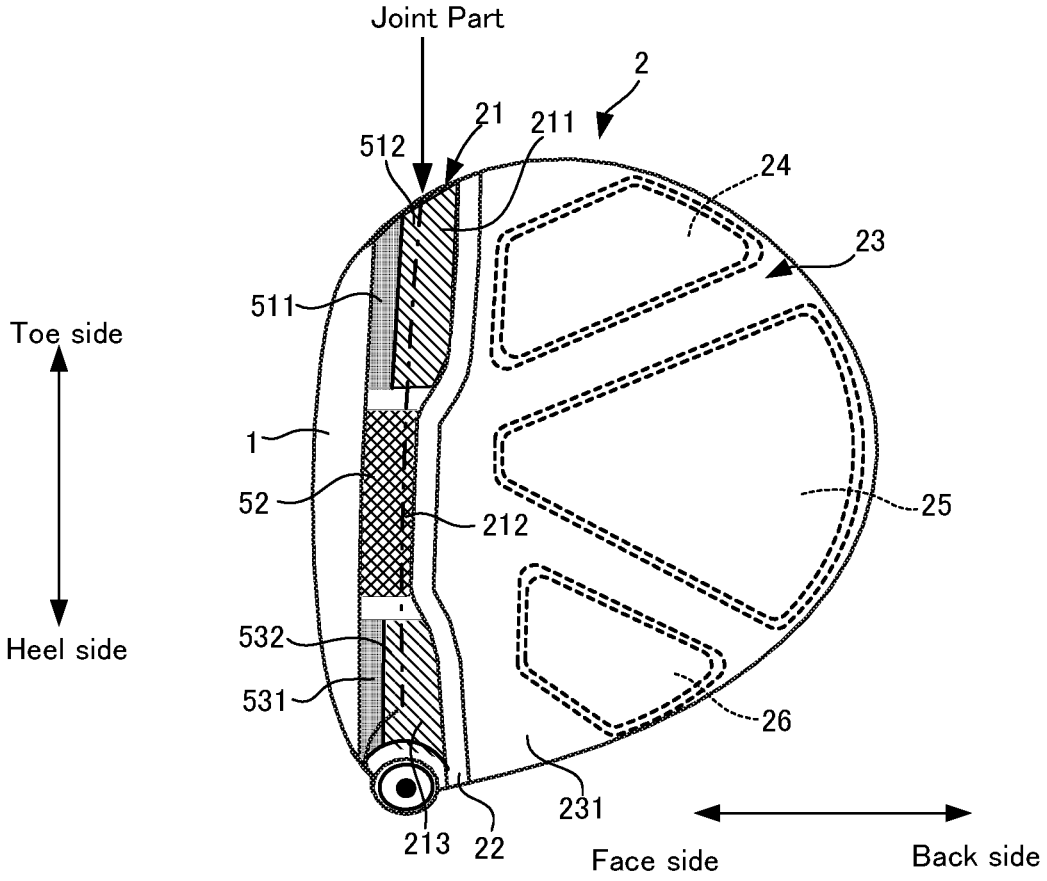
FIG. 6 is a plan view illustrating a state in which the face member and the head main body have been joined.

As illustrated in FIG. 6, the first toe-side edge part 211 and the rear-side second toe-side edge part 512 have the same thickness, and are integrated. Likewise, the first central edge part 212 and the second central edge part 52, and the first heel-side edge part 213 and the rear-side second heel-side edge part 532, have the same corresponding thicknesses as well, and are integrated as a result of the welding.

6. Effects

The golf club head according to the present embodiment, configured as described above, can achieve the following effects.

(1) The end surface of the opening 30 in the head main body 10, and the end surface of the peripheral edge part 5 of the face member 20 that is joined to the end surface of the opening 30, extend parallel to the face part 1. In particular, both joint surfaces in the crown part 2 extend linearly along the toe-heel direction. The joint precision can therefore be improved when welding.

(2) In the crown part 2 of the head main body 10, the first toe-side edge part 211, the first central edge part 212, and the first heel-side edge part 213 are provided in an edge part on the opening 30 side, in the direction from the toe side to the heel side. The first toe-side edge part 211 and the first heel-side edge part 213 are thinner than the first central edge part 212, and are longer than the first central edge part 212 in the face-back direction. Thus, in the edge part on the opening 30 side in the crown part 2, the toe side and the heel side flex more easily, and thus an area of high rebound can be extended to the toe side and the heel side, rather than being limited to the vicinity of the center in the toe-heel direction.

(3) In the peripheral edge part 5 of the face member 20, the second toe-side edge part 51, the second central edge part 52, and the second heel-side edge part 53 are provided in that order from the toe side to the heel side. The second toe-side edge part 51 and the second heel-side edge part 53 are formed thinner than the second central edge part 52. Thus, in the peripheral edge part 5 of the face member 20, the toe side and the heel side flex more easily, and thus an area of high rebound can be extended to the toe side and the heel side, rather than being limited to the vicinity of the center in the toe-heel direction.

(4) In the head main body 10, the first toe-side edge part 211 and the first heel-side edge part 213 of the front side region 21 are thinner than the first central edge part 212, but are made thicker than the rear side region 23. Thus, the strength of regions close to the face part 1, which experiences higher stress when striking a ball, can be increased, which makes it possible to improve the durability. The end surface of the opening 30 in the head main body 10 is also made thicker, which makes it possible to increase the strength of the joint with the face member 20.

(5) In the front side region 21 of the head main body 10, the rear-end edge of the first central edge part 212 is located further on the face side than the rear-end edges of the first toe-side edge part 211 and the first heel-side edge part 213. Thus, the thin rear side region 23 is closer to the face part 1 near the center in the toe-heel direction than on the toe side and the heel side. Accordingly, the crown part 2 is made more flexible near the center in the toe-heel direction, which is more likely to be a point of contact, which makes it possible to improve the rebound performance. On the other hand, the thick first central edge part 212 and second central edge part 52 are arranged near the center, in the toe-heel direction, of a region close to the face part 1, which makes it possible to increase the durability as well. This makes it possible to achieve both an improvement in strength and an improvement in rebound performance.

(6) The rear side region 23 of the head main body 10 is thin, and thus the amount by which the weight of the thin part is reduced can be distributed to other parts of the head. This increases the freedom with which the head can be designed. For example, the center of gravity of the head can be lowered by distributing the stated weight to the sole part 3 of the head main body 10. Furthermore, the rear side region 23 is provided with the plurality of thin parts 24 to 26, and thus the center of gravity of the head can be lowered even further.

(7) In the peripheral edge part 5 of the face member 20, the thick front-side second toe-side edge part 511 and front-side second heel-side edge part 531 are provided on the face side, i.e., on the side subjected to impacts. This makes it possible to increase the strength of the peripheral edge part 5. On the other hand, the thin rear-side second toe-side edge part 512 and rear-side second heel-side edge part 532 are provided on the back sides of the front-side second toe-side edge part 511 and the front-side second heel-side edge part 531, which makes it possible to improve the rebound performance.

Additionally, in the present embodiment, the thin rear-side second toe-side edge part 512 and rear-side second heel-side edge part 532 are provided on the back side of the peripheral edge part 5, which lightens the peripheral edge part 5.

In addition to this, joint parts between the head main body 10 and the face member 20 are not provided, for example, at the boundary between the front-side second toe-side edge part 511 and the rear-side second toe-side edge part 512 or at the boundary between the front-side second heel-side edge part 531 and the rear-side second heel-side edge part 532, as illustrated in FIG. 5. In other words, joint parts are not provided at parts where steps may be formed, and thus a drop in strength can be suppressed.

(8) Using a cup face construction provides the following advantages. First, if the head main body 10 and the face member 20 are joined through welding, the joint parts are more rigid. The highly-rigid joint parts are separated from the face part 1 by the peripheral edge part 5 of the face member 20, and thus the face part 1 can flex greatly when striking a ball. The rebound performance of the head can be improved as a result.

Additionally, the head main body 10 is separated from the face surface, and the head main body 10 is separated from the face part 1, by the peripheral edge part 5. The head main body 10 thus does not require the same strength as the face member 20, and can thus be made thinner than the face member 20. As a result, the head main body 10, which has been made thinner, can be caused to flex when striking a ball, in addition to the face member 20. This contributes to an improvement in the rebound performance of the head.

7. Variations

An embodiment of the present invention has been described thus far. However, the present invention is not intended to be limited to the above-described embodiment. Many variations can be made thereon without departing from the essential spirit of the present invention. The following variations are possible, for example.

7.1

Although the movement region 22 and the movement parts 214, 215, 54, and 55 are provided in the foregoing embodiment, parts such as these may be omitted. The thin parts 24 to 26 of the head main body 10 may also be provided as needed, and the shapes thereof are not particularly limited. The thin parts 24 to 26 can also be omitted entirely.

7.2

In the foregoing embodiment, the rear-side second toe-side edge part 512 of the face member 20 and the first toe-side edge part 211 of the head main body 10 have constant thicknesses. Likewise, the rear-side second heel-side edge part 532 of the face member 20 and the first heel-side edge part 213 of the head main body 10 have constant thicknesses. However, these may be varied instead. Alternatively, in a state where the head main body 10 and the face member 20 are integrated, the thickness from the front-end edge of the rear-side second toe-side edge part 512 to the rear-end edge of the first toe-side edge part 211 can be reduced progressively. Likewise, the thickness from the front-end edge of the rear-side second heel-side edge part 531 to the rear-end edge of the first heel-side edge part 213 can be reduced progressively as well.

7.3

In the foregoing embodiment, the first toe-side edge part 211, the first central edge part 212, and the first heel-side edge part 213 are provided in the edge part of the crown part 2 on the opening 30 side. Furthermore, the second toe-side edge part 51, the second central edge part 52, and the second heel-side edge part 53 are provided in the peripheral edge part 5 of the face member 20, which is joined to the crown part 2. However, the face member 20 need not be provided with such regions of different thicknesses. In other words, the present invention can improve the rebound performance on the toe side and the heel side with only the first toe-side edge part 211, the first central edge part 212, the first heel-side edge part 213 provided in the crown part 2 as well.

7.4

Although the foregoing embodiment describes the configurations of the crown part 2 and the face member 20, and the structure of the peripheral edge part 5 in particular, the structure of the face part 1 is not particularly limited. For example, the center of the face part 1 is made thicker to increase the mechanical strength against impacts, but the thicknesses of that and other regions are not particularly limited.

LIST OF REFERENCE NUMERALS

1 Face Part
5 Peripheral edge part
511 Front-side second toe-side edge part
512 Rear-side second toe-side edge part
52 Second central edge part
53 Second heel-side edge part
531 Front-side second heel-side edge part
532 Rear-side second heel-side edge part
2 Crown part
21 Front side region
211 First toe-side edge part
212 First central edge part
213 First heel-side edge part
22 Movement region
24 to 26 Thin parts
3 Sole part

What is claimed is:

1. A golf club head comprising:

a head main body including a crown part and a sole part, and having an opening surrounded by the crown part and the sole part; and a face member covering the opening in the head main body, wherein the face member is formed in a cup-like shape, including a face part formed in a planar shape and a peripheral edge part extending from a peripheral edge of the face part;

an end surface of the crown part forming the opening in the head main body is formed extending parallel to an end surface of the peripheral edge part of the face part and extending substantially straight in toe-heel direction excluding a hosel section, the crown part of the head main body including:

a front-side region extending in a toe-heel direction along an edge part on the side where the opening is located; and a rear-side region located further on a back side than the front-side region and being thinner than the front-side region, the front-side region including: a first toe-side edge part located on a toe side; a first heel-side edge part located on a heel side; and a first central edge part located between the first toe-side edge part and the first heel-side edge part and being thicker than the first toe-side edge part and the first heel-side edge part, and the first toe-side edge part and the first heel-side edge part are longer than the first central edge part in the face-back direction.

2. The golf club head according to claim 1, wherein a part of the peripheral edge part of the face member, extending along the crown part, includes a second toe-side edge part, a second heel-side edge part, and a second central edge part joined to the first toe-side edge part, the first heel-side edge part, and the first central edge part, respectively; and the second central edge part is thicker than the second toe-side edge part and the second heel-side edge part.

3. The golf club head according to claim 2, wherein the second toe-side edge part includes a front-side second toe-side edge part located on a face side and a rear-side second toe-side edge part located on a back side;

the second heel-side edge part includes a front-side second heel-side edge part located on the face side and a rear-side second heel-side edge part located on the back side;

the front-side second toe-side edge part is thicker than the rear-side second toe-side edge part; and the front-side second heel-side edge part is thicker than the rear-side second heel-side edge part.

4. The golf club head according to claim 3, wherein the rear-side second toe-side edge part and the first toe-side edge part are joined, and have the same thickness; and the rear-side second heel-side edge part and the first heel-side edge part are joined, and have the same thickness.

5. The golf club head according to claim 4, wherein the head is formed so that a thickness progressively decreases from a face-side end edge of the rear-side second toe-side edge part toward a back-side end edge of the first toe-side edge part; and a thickness progressively decreases from a face part-side end edge of the rear-side second heel-side edge part toward a back-side end edge of the first heel-side edge part.

6. The golf club head according to claim 1, wherein a movement region extending in the toe-heel direction and having a thickness that changes progressively is provided between the front-side region and the rear-side region.

7. The golf club head according to claim 1, wherein at least one thin part is formed in the rear-side region.

8. A golf club head comprising:

a head main body including a crown part and a sole part, and having an opening surrounded by the crown part and the sole part; and a face member covering the opening in the head main body, wherein the face member is formed in a cup-like shape, including a face part formed in a planar shape and a peripheral edge part extending from a peripheral edge of the face part;

an end surface forming the opening in the head main body is formed extending parallel to the face part, the crown part of the head main body including:

a front-side region extending in a toe-heel direction along an edge part on the side where the opening is located; and a rear-side region located further on a back side than the front-side region and being thinner than the front-side region, the front-side region including:

a first toe-side edge part located on a toe side;

a first heel-side edge part located on a heel side; and a first central edge part located between the first toe-side edge part and the first heel-side edge part and being thicker than the first toe-side edge part and the first heel-side edge part, and the first toe-side edge part and the first heel-side edge part are longer than the first central edge part in the face-back direction, wherein a part of the peripheral edge part of the face member, extending along the crown part, includes a second toe-side edge part, a second heel-side edge part, and a second central edge part joined to the first toe-side edge part, the first heel-side edge part, and the first central edge part, respectively;

the second central edge part is thicker than the second toe-side edge part and the second heel-side edge part;

the second toe-side edge part includes a front-side second toe-side edge part located on a face side and a rear-side second toe-side edge part located on a back side;

the second heel-side edge part includes a front-side second heel-side edge part located on the face side and a rear-side second heel-side edge part located on the back side;

the front-side second toe-side edge part is thicker than the rear-side second toe-side edge part; and the front-side second heel-side edge part is thicker than the rear-side second heel-side edge part.

9. The golf club head according to claim 8, wherein the rear-side second toe-side edge part and the first toe-side edge part are joined, and have the same thickness; and the rear-side second heel-side edge part and the first heel-side edge part are joined, and have the same thickness.

10. The golf club head according to claim 9, wherein the head is formed so that a thickness progressively decreases from a face-side end edge of the rear-side second toe-side edge part toward a back-side end edge of the first toe-side edge part; and a thickness progressively decreases from a face part-side end edge of the rear-side second heel-side edge part toward a back-side end edge of the first heel-side edge part.

* * * * *